United States Patent [19]

Kimmelman

[11] Patent Number: 4,523,797

[45] Date of Patent: Jun. 18, 1985

[54] CONNECTOR ADAPTOR

[75] Inventor: Samuel Kimmelman, Cranford, N.J.

[73] Assignee: Parker Hannifin Corporation, Cleveland, Ohio

[21] Appl. No.: 473,413

[22] Filed: Mar. 9, 1983

[51] Int. Cl.[3] ..... H01R 3/00; H01R 13/42

[52] U.S. Cl. ..... 339/147 R; 339/217 R

[58] Field of Search ..... 339/31 R, 32 R, 33, 339/147 R, 154 R, 154 A, 156 R, 157 R, 217 R, 221 R, 221 M, 31 M, 32 M, 28

[56] References Cited

U.S. PATENT DOCUMENTS

| | | | |
|---|---|---|---|
| 1,617,810 | 2/1927 | Hubbell | 339/166 R |
| 1,928,345 | 9/1933 | Wisman | 324/408 |
| 2,805,403 | 9/1957 | Road | 339/31 |
| 2,809,361 | 10/1957 | Woofter et al. | 339/176 M |
| 3,014,195 | 12/1961 | May et al. | 339/131 |
| 3,264,600 | 8/1966 | Barth et al. | 339/31 |
| 3,315,210 | 4/1967 | Cull | 339/32 |
| 3,320,573 | 5/1967 | Machts et al. | 339/185 |
| 3,356,986 | 12/1967 | Ege | 339/193 |
| 3,384,865 | 5/1968 | Bosworth | 339/193 |
| 3,393,394 | 7/1968 | Orr | 339/64 |
| 3,500,288 | 3/1970 | Startin et al. | 339/17 C |
| 3,667,101 | 6/1972 | Kloth | 339/28 X |
| 3,766,513 | 10/1973 | Carre | 339/31 R |
| 3,816,821 | 6/1974 | Rhodes | 339/198 R |
| 4,073,563 | 2/1978 | Bailey et al. | 339/128 |
| 4,274,701 | 6/1981 | Bannert et al. | 339/217 S |
| 4,297,726 | 10/1981 | Nicholson et al. | 358/254 |
| 4,410,225 | 10/1983 | Stoewe et al. | 339/31 R |

FOREIGN PATENT DOCUMENTS

| | | | |
|---|---|---|---|
| 138083 | 12/1978 | Japan | 339/221 R |

*Primary Examiner*—John McQuade
*Assistant Examiner*—Steven C. Bishop
*Attorney, Agent, or Firm*—Frederick L. Tolhurst

[57] ABSTRACT

An adaptor for modifying connector arrangements of electrical components in which connectors such as terminals (16) that are electrically connected to a component (14) are located according to apertures (36–40). The terminals, which are already fastened to the conductor, are laterally received into the aperture through channels (42–46) and slots (66–70). Shoulders (48–52) support terminals (16) above the adaptor face (26) and grooves (54–58) determine the angular orientation of the terminals.

7 Claims, 8 Drawing Figures

CONNECTOR ADAPTOR

BACKGROUND OF THE INVENTION

1. Field of the Invention

The subject invention is directed to apparatus for modifying electrical connector arrangements and, more particularly, adaptors for maintaining conductor connectors in a selected arrangement.

2. Description of the Prior Art

Modular electrical components having plug-in type connectors have been widely used for many years because of their advantageous cost and serviceability. Examples of various components and plug-in connectors are shown in U.S. Pat. Nos. 3,014,195; 3,264,600; 3,320,573; 3,356,986; 3,393,394; 3,766,513; 4,073,563; 4,274,701; and 4,297,726. Such components can be reliably and efficiently made in production quantities and can be stored in inventory as available replacement parts for convenient and economical repairs. However, one problem with such plug-in type components has been that the connectors are necessarily arranged in one particular fixed arrangement. The component will not engage a connector board or receptacle that provides for connectors in any different location or orientation. Thus, available components that would otherwise be suitable for an application cannot be used if the component's connector configuration is different from the design of the connector board or receptacle.

For example, flasher relays for automotive electrical systems are typically a plug-in modular component having a common basic operation and function. However, while automobiles manufactured in the United States employ a flasher relay with one terminal configuration, automobiles manufactured elsewhere require flashers with one of a number of different terminal configurations. Thus a flasher suitable for use on domestically manufactured automobiles has not been suitable for use on imported automobiles.

To provide components having all the connector configurations that may potentially be needed demands stocking a broad inventory of parts. Moreover, if a component of a particular connector configuration is out-of-stock or becomes unavailable, the required connector arrangement bars the use of equivalent competitive components to complete the repairs.

It has been recognized that devices that could modify the terminal or receptacle arrangements of components or connector boards would permit use of a single style component and avoid the expense and difficulty of maintaining a broad range of components to cover various connector arrangements. Accordingly, various devices developed in the prior art that were intended for use in modifying the connector array of plug-in type components and connector boards. One example of such a device is shown in U.S. Pat. No. 3,384,865.

One problem with such adaptor devices known in the prior art has been that many such designs required the connectors to be connected to the conductor leads after assembly with the adaptors. This proved awkward or even impossible in some applications and was found to be time-consuming and costly. In other cases, the connectors of the conductor leads did not extend from the adaptor and were incompatible with many types of connector blocks and plugs. Another problem with prior art adaptors was that they did not rigidly fix the connectors so that they could inadvertently lose their position or orientation in the adaptor, making assembly more difficult.

Accordingly, there was a need in the prior art for an adaptor that would securely fasten the connectors; that was compatible with various existing connector blocks and plugs; and that could be assembled with the connector already attached to the conductor leads.

SUMMARY OF THE INVENTION

In accordance with the subject invention, an adaptor locates the conductor connectors in a selected arrangement on the adaptor face. The adaptor includes an opening that laterally maintains the connector on the adaptor face and a slot adjacent to and longitudinally aligned with the opening such that the connector is laterally received into the opening through the slot. Recessed shoulders located adjacent the periphery of the opening operate as a stop against longitudinal movement of the connector toward the face.

Preferably, the recessed shoulders are formed by grooves that are located in the face adjacent the periphery of the opening and maintains the connector in a selected angular orientation. More preferably, the opening is provided with a narrowing internal diameter that retains the connector against the recessed shoulder and cooperates with the shoulder and grooves to maintain the connector in fixed relation on the adaptor face.

Also preferably, the adaptor includes a plate having a plurality of apertures extending between a face surface and a back surface. A plurality of support tubes are connected to the back surface, the support tubes being respectively adjacent the periphery of the apertures. Channels are provided between the periphery of the apertures and one edge of the plate, and longitudinally aligned slots are provided in the tubes such that the connector can pass laterally through the channels and slots and be received in the openings formed by the apertures and tubes. Grooves forming recessed shoulders are provided in the face surface of the plate adjacent the periphery of the aperture.

Other details, objects and advantages of the subject invention will become apparent from the following description of a presently preferred embodiment thereof.

BRIEF DESCRIPTION OF THE DRAWINGS

The accompanying drawings show a presently preferred embodiment of the invention wherein.

DESCRIPTION OF THE PREFERRED EMBODIMENT OF THE INVENTION

Figure 1:
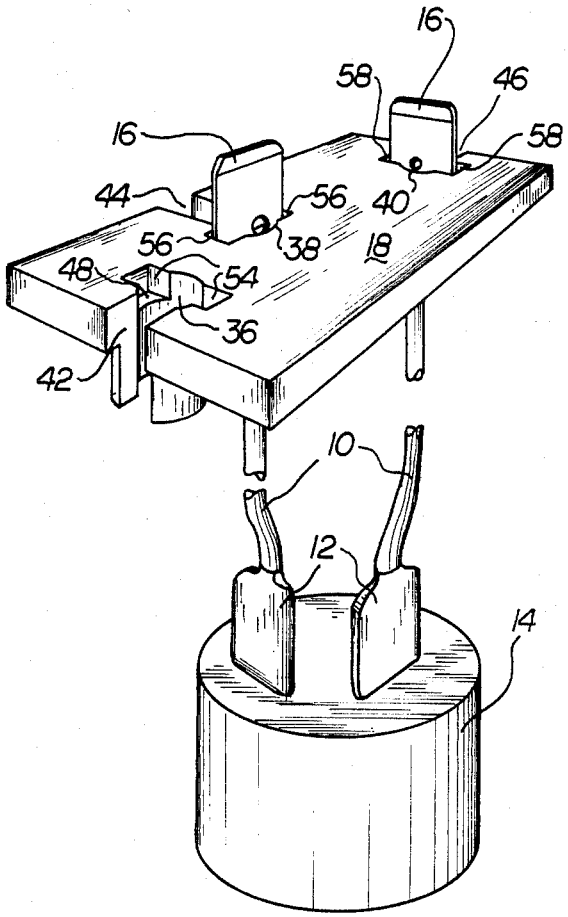
FIG. 1 is a perspective view of the flasher, conductor and adaptor kit as herein disclosed.

As shown in FIG. 1, electrical conductors 10 have connectors such as receptacles 12 at one end connected to the terminals of a modular electrical component such as flasher relay 14. At the opposite end, conductors 10 have connectors such as terminals 16 that are engaged in an adaptor 18. Although flat-type terminals and receptacles are shown and described in connection with the presently preferred embodiment, the subject invention is not limited to use of such connectors, but extends to many other types of connectors as will be apparent to those skilled in the art.

As hereafter more fully explained, adaptor 18 is provided with a plurality of openings and grooves that determine the location and orientation of terminals 16 in correspondence and a given connector arrangement in a receptacle block or plug. Thus, adaptor 18 modifies the terminal arrangement of flasher 14 to make it compatible with any selected receptacle arrangement in which the receptacles have a different location or orientation.

Figure 2:
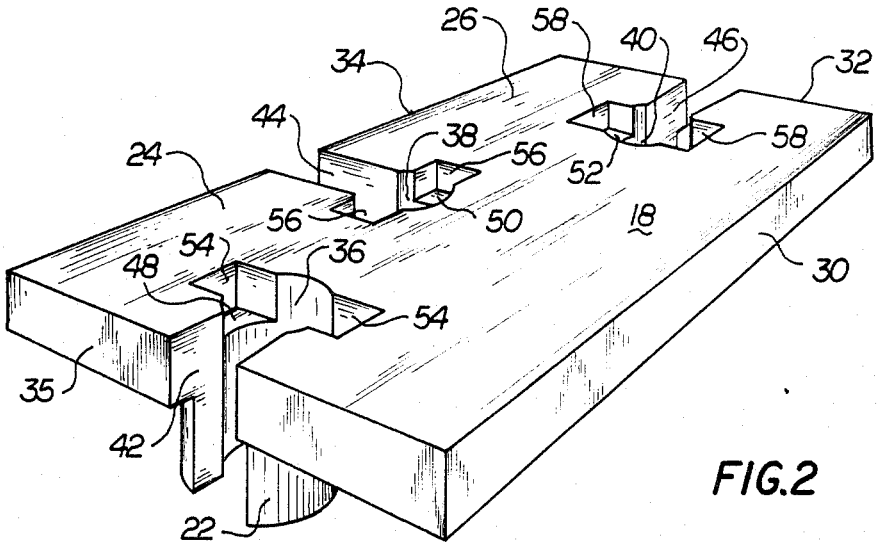
FIG. 2 is a perspective view of the adaptor shown in FIG. 1.
Figure 3:
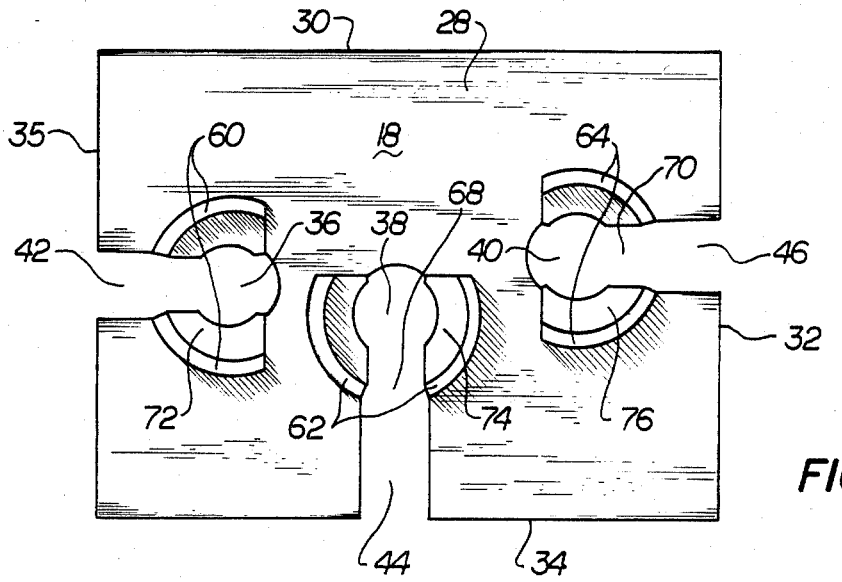
FIG. 3 is a bottom plan view of the adaptor shown in FIG. 2.
Figure 4:
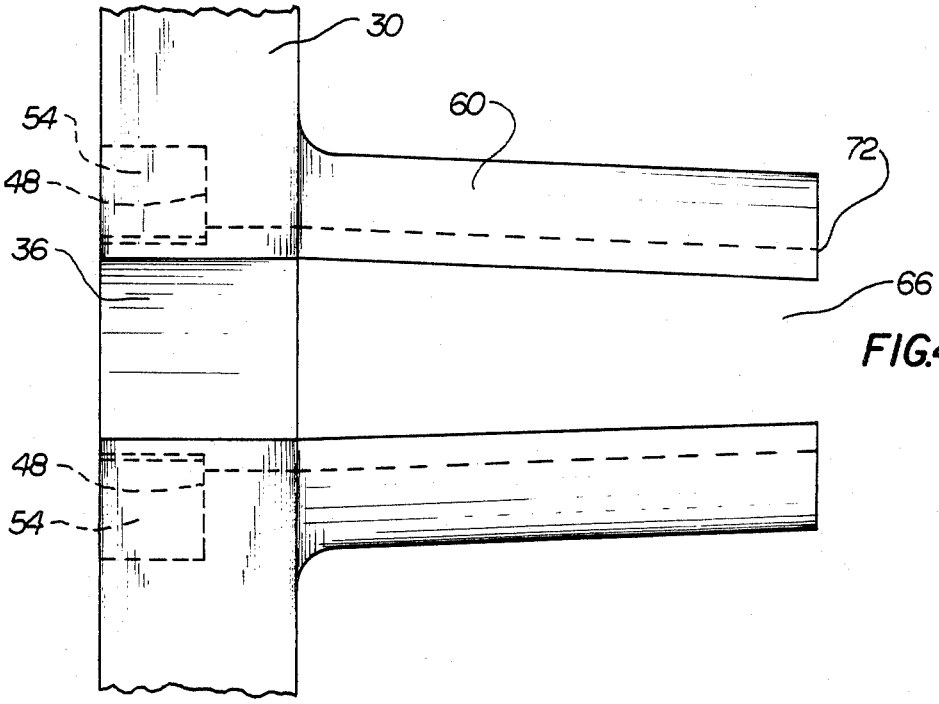
FIG. 4 is a partial side elevation of the adaptor of FIG. 3.
Figure 5:
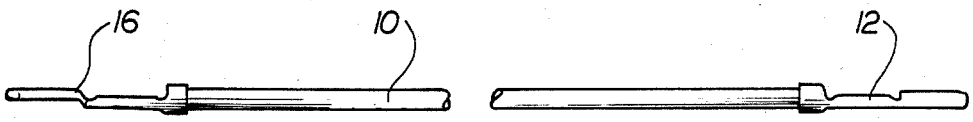
FIG. 5 is a conductor as shown in FIG. 1.

Adaptor 18 is more fully described with reference to FIGS. 2, 3 and 4. As shown in FIGS. 2, 3 and 4, adaptor 18 includes a plate 24 having face surface 26 and a back surface 28 and edges 30, 32, 34 and 35. Plate 24 further includes apertures 36, 38 and 40 and channels 42, 44 and 46 extending between an edge of plate 24 and the periphery of apertures 36, 38 and 40 respectively. Adjacent the periphery of apertures 36–40 are recessed shoulders 48, 50 and 52 that are formed by grooves 54, 56 and 58 in face surface 26 of plate 24.

Support tubes 60, 62, and 64 are connected to back surface 28 about the periphery of apertures 36, 38 and 40 respectively. Support tubes 60–64 are respectively provided with slots 66, 68 and 70 that are aligned with the longitudinal axis of the support tubes such that terminals 16 or conductors 10 can pass therethrough to be laterally received in apertures 36–40 and tubes 60–64 as is hereafter more fully explained.

The internal diameter of support tubes 60–64 is tapered such that it is smaller at the distal ends 72, 74 and 76 then adjacent back surface 28. Thus, the internal passageway of tubes 60–64 is in the general shape of a conical frustum with the width adjacent the face surface 26 being greater than the width remote from the face.

Figure 6:
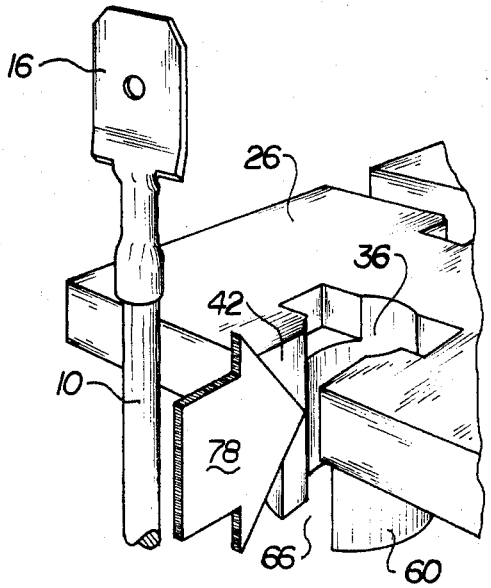
FIGS. 6–8 illustrate the assembly of the terminal of the conductor of FIGS. 1 and 5 with the adaptor of FIGS. 1–4 in accordance with the subject invention.
Figure 7:
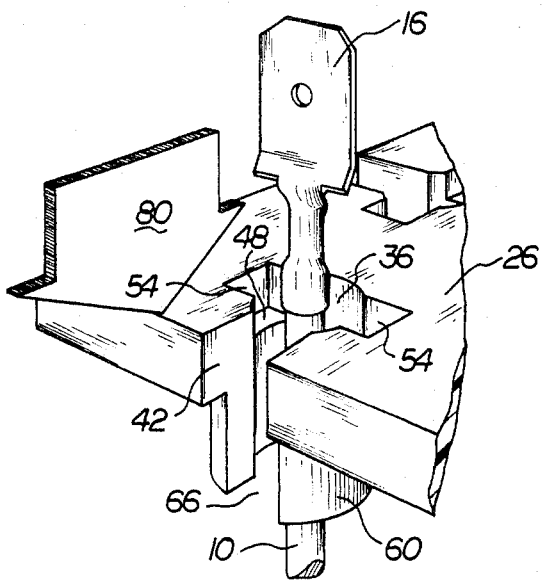
Figure 8:
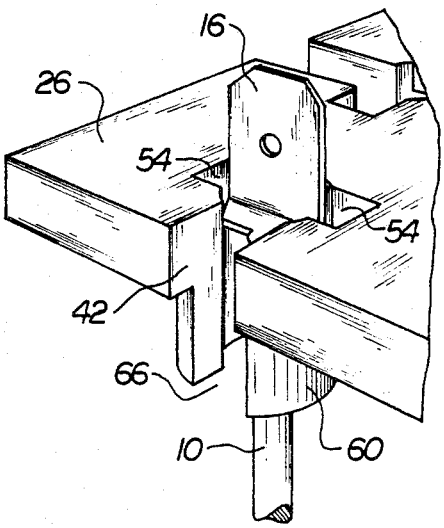

The assembly and operation of adaptor 18 and terminals 16 is further explained with respect to FIGS. 6–8. As illustrated in FIG. 6, conductor 10 having terminal 16 attached to the end thereof is longitudinally aligned with channel 42 and slot 66. Conductor 10 is then translated laterally through channel 42 and slot 66 in the direction of arrow 78 until it is received in the opening formed by aperture 36 and support tube 60.

With conductor 10 located in the position of the opening formed by aperture 36 and tube 60, terminal 16 is secured in the opening by angularly rotating terminal 16 to bring it into registry with shoulders 48 and grooves 54. Terminal 16 is then manually forced longitudinally in the direction of arrow 80 into the opening.

FIG. 8 shows terminal 16 secured in the opening of aperture 36 and tube 60. Terminal 16 is laterally maintained in the opening by the sides of apertures 36 and groove 54 so that the location of the opening determines the position of terminal 16 on face surface 26. Preferably, grooves 54 are aligned orthogonally with respect to slots 66. Shoulder 48 operates as a stop against the back edge of terminal 16 to maintain terminal 16 extending normally from face surface 26. The angular position of grooves 54 about the periphery of aperture 36 determine and maintain the angular orientation of terminal 16 on face surface 26.

The internal diameter and taper angle of support tube 60 are dimensioned such that support tube 60 retains terminal 16 in its longitudinal position in the opening and opposes movement of terminal 16 out of the opening in the opposite direction from arrow 80 in FIG. 7. Accordingly, the length of support tubes 60–64 is substantially equal to the length of terminals 16 to increase the retention force of support tube 60. This also affords additional protection for the terminal from mechanical damage and electrical short circuits.

While a presently preferred embodiment of the subject invention is shown and described herein, it is to be understood that the invention is not limited thereto but may be otherwise variously embodied within the scope of the following claims.

I claim:

1. An adaptor for locating a plurality of connectors in a selected array on one face of the adaptor, said adaptor comprising:

a plate having a face surface and a back surface that are separated by at least one edge surface, said plate further having a plurality of apertures, a plurality of channels, and a plurality of recessed shoulders with at least one of said channels located between the periphery of one of said apertures and an edge of the plate, and with at least one of said recessed shoulders adjacent to the periphery of one of said apertures; and a plurality of support tubes connected to the back surface of said plate, each of said tubes being located adjacent to a respective one of said apertures and having a longitudinal slot for receiving one of said connectors therethrough.

2. The adaptor of claim 1 wherein said recessed shoulders are formed by grooves in the face surface, each of said grooves being located about the periphery of a respective one of said apertures to determine the angular orientation of a corresponding one of said connectors.

3. The adaptor of claim 1 or 2 wherein the length of each of said support tubes corresponds to the length of a respective one of said connectors.

4. The adaptor of claim 1 or 2 wherein said tubes are located adjacent the periphery of a respective one of said apertures, and wherein the internal diameter of said tubes is smaller at the distal end of the tubes than adjacent to said plate.

5. The adaptor of claim 4 wherein the internal diameter of said tubes is tapered from a larger diameter adjacent the plate to a smaller diameter adjacent the distal end of the tubes.

6. A flasher relay kit comprising:

an electrical flasher relay having terminals arranged in a first selected location and orientation;

a plurality of conductors corresponding respectively to the flasher relay terminals, each of said conductors having a connector at one end for engaging the corresponding flasher relay terminal, and having a connector at the opposite end for engaging a respective one of a plurality of connectors that are arranged in a second selected location and orientation;

an adaptor for locating and orienting the conductor connectors at the opposite end in correspondence with the connectors arranged in the second selected location and orientation, said adaptor having a face surface with a plurality of openings located in corresondence with the location of the connectors in the second selected location and orientation, slots adjacent each of said openings for laterally receiving the conductor connector into the openings, and shoulders formed by grooves located adjacent the periphery of each of said openings for longitudinally supporting one of the connectors in a respective one of said openings and orienting the one connector in correspondence with the orientation of connectors arranged in the second selected location and orientation.

7. The flasher relay kit of claim 6 wherein at least a portion of each of the adaptor openings is tapered to a decreasing width in a direction away from said face surface.

* * * * *